US006851971B2

(12) United States Patent
Forsberg

(10) Patent No.: US 6,851,971 B2
(45) Date of Patent: Feb. 8, 2005

(54) TERMINAL BLOCK, BRIDGING CLIP, AND BRIDGING CLIP STRIP

(75) Inventor: Kevin Forsberg, Orlando, FL (US)

(73) Assignee: Bellsouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/252,192

(22) Filed: Sep. 23, 2002

(65) Prior Publication Data

US 2004/0106322 A1 Jun. 3, 2004

(51) Int. Cl.[7] ..... H01R 31/08

(52) U.S. Cl. ..... 439/511; 439/579; 439/595; 439/638; 439/752; 439/608

(58) Field of Search ..... 439/511, 579, 439/595, 638, 752, 49, 66, 79, 610, 404, 410, 246, 252, 608, 570, 571, 509, 532, 716–719; 200/51 R, 532, 530, 531

(56) References Cited

U.S. PATENT DOCUMENTS

| | | | | |
|---|---|---|---|---|
| 4,277,663 | A | | 7/1981 | Soes |
| 4,352,964 | A | | 10/1982 | English |
| 4,356,361 | A | | 10/1982 | Schwab |
| 4,427,851 | A | | 1/1984 | Schwab |
| 4,466,048 | A | | 8/1984 | Schwab |
| RE31,714 | E | | 10/1984 | Knickerbocker |
| 4,553,802 | A | * | 11/1985 | Ruehl |
| 4,631,377 | A | | 12/1986 | Imazeki |
| 4,670,630 | A | | 6/1987 | Kikta |
| 4,883,430 | A | | 11/1989 | Siemon |
| 4,954,670 | A | | 9/1990 | Jensen |
| 5,035,645 | A | | 7/1991 | Siemon |
| 5,296,663 | A | * | 3/1994 | Borchardt et al. |
| 5,803,242 | A | * | 9/1998 | Takano et al. |
| 5,857,870 | A | | 1/1999 | Carter |
| 6,011,224 | A | | 1/2000 | Zdanys |
| 6,483,061 | B1 | * | 11/2002 | Harvey et al. |

* cited by examiner

*Primary Examiner*—Dean A. Reichard
*Assistant Examiner*—Nguyen T. Ha
(74) *Attorney, Agent, or Firm*—Walters & Zimmerman; Geoff Sutcliffe; Todd Mitchem

(57) ABSTRACT

A terminal block includes a block body, a plurality of conductive terminals, and a switch assembly. The block body has a front surface, and each conductive terminal has a portion outwardly extending from the front face. The plurality of conductive terminals is arranged in an array of rows and columns, with each row having at least one pair of conductive terminals. The switch assembly has an open position and a closed position, with the closed position permitting electrical communication between conductive terminals in a row of the array. The open position does not permit electrical communication between conductive terminals in the row.

8 Claims, 8 Drawing Sheets

TERMINAL BLOCK, BRIDGING CLIP, AND BRIDGING CLIP STRIP

BACKGROUND OF THE INVENTION

1. Field of the Invention

This invention generally relates to terminal blocks and to electrical connectors for terminal blocks and, more particularly, to electrical bridging clips for connecting post-type conductive terminals.

2. Description of the Related Art

Terminal blocks are extensively used in telecommunications. A terminal block, for example, typically represents a demarcation point in a telecommunications network. A communication cable that enters the terminal block is the responsibility of the telecommunications service provider. The customer, however, is responsible for the installation and the maintenance of a communication cable that runs from the terminal block and into the customer's premises. An electrical bridging clip is then used in the terminal block to interconnect the customer's cable with the telecommunication service provider's cable.

These electrical bridging clips connect adjacent terminals in the terminal block. A well-known electrical bridging clip is a one-piece metal connector having a "U"-shape. This type of electrical bridging clip is discussed and disclosed in U.S. Pat. No. 4,029,376 to Headington et al. (Jun. 14, 1977), U.S. Design Pat. No. 224,406 to Heck (Jul. 25, 1972), and U.S. Pat. No. 4,575,168 to Thomas (Mar. 11, 1986). When connecting these terminals in the terminal block, the individual bridging clip is visually aligned with the desired terminals and forced onto the terminals. The force must be great enough to overcome the bias of the "U"-shape clip.

These prior art electrical bridging clips, however, have many disadvantages. The prior art designs are very small and, thus, difficult to handle. Because the prior art bridging clips are so small, an installing technician often has difficulty aligning the bridging clip with the terminals. If the installing technician touches the wrong terminal, a short or a voltage spike can occur. The small bridging clips are often lost after removal, so the technician must locate a replacement bridging clip. These problems are greatly multiplied when the terminal block has fifty (50) or more rows of terminals, with each row requiring a bridging clip. The prior art electrical bridging clips, in short, are very cumbersome, thus increasing installation/repair times and labor costs.

There is, accordingly, a need in the art for a terminal block design that reduces the need for these prior art electrical bridging clips, a need for an electrical bridging clip that reduces the occurrence of shorts and voltage spikes, a need for an electrical bridging clip that is easier and faster to install, and a need for an electrical bridging clip that reduces labor costs during installation and repair.

BRIEF SUMMARY OF THE INVENTION

This invention is an improved design for a terminal block and for an electrical bridging clip. The improved terminal block reduces the need for bridging clips, thus making telecommunication installations faster and cheaper. The improved electrical bridging clip of this invention eliminates the small, cumbersome design of the prior art, and this design is faster to install and easier to maintain. Both the improved terminal block and the improved electrical bridging clip utilize a switch assembly to open and close a connection between post-type terminals in the terminal block.

One embodiment of this invention describes a terminal block. The terminal block includes a block body. The block body has a front surface and a plurality of conductive terminals outwardly extending from the front surface. The plurality of conductive terminals is arranged in an array of rows and columns, with each row having at least one pair of conductive terminals. The block body also includes a switch assembly. The switch assembly has an open position and a closed position. The closed position permits electrical communication between conductive terminals in a row of the array. The open position, however, substantially does not permit electrical communication between conductive terminals in the row. The term "electrical communication" means the transmission of current and voltage between the switch assembly and the conductive terminals. This electrical communication is commonly achieved when the switch assembly has contact path with the conductive terminals, thus allowing current and voltage to flow. Electrical communication, however, is also possible by electromagnetic induction.

Another embodiment describes an electrical bridging clip. This electrical bridging clip has a first and a second electrical contact in electrical communication with a switch assembly. The first electrical contact is for electrically communicating with a first conductive terminal of a terminal block. The second electrical contact, likewise, is for electrically communicating with a second conductive terminal of the terminal block. The switch assembly has an open position and a closed position. The closed position permits electrical communication between the first and the second electrical contact, while the open position substantially does not permit electrical communication between the first and the second electrical contact. When the electrical bridging clip is installed in the terminal block, the switch assembly permits electrical communication between the first and second conductive terminals via the first and second electrical contacts.

Yet another embodiment also describes an electrical bridging clip. This embodiment of an electrical bridging clip has a housing. The housing has a top face, a bottom face, and a cavity. The cavity upwardly extends from the bottom face and into an interior region of the housing. The cavity terminates at an opening on the bottom face, the opening and the cavity are sized to accept at least two conductive terminals from a terminal block. The electrical bridging clip also includes a switch assembly and at least two electrical contacts disposed in the cavity. The switch assembly electrically communicates with the at least two electrical contacts. The switch assembly has an open position and a closed position. The closed position permits electrical communication between the at least two electrical contacts, while the open position substantially does not permit electrical communication between the at least two electrical contacts. When the electrical bridging clip is installed in the terminal block, the at least two conductive terminals in the terminal block insert into the cavity, and the switch assembly permits an electrical connection between the at least two conductive terminals via the electrical contacts.

An alternative electrical bridging clip is also disclosed. This alternative electrical bridging clip has a housing comprising a top face, a bottom face, and at least one pair of spaced cavities. Each cavity upwardly extends from the bottom face and into an interior region of the housing. Each cavity terminates at an opening on the bottom face, and each opening and each cavity is sized to accept an electrical terminal from a terminal block. An electrical contact is disposed in each cavity, and a switch assembly electrically communicates with the electrical contact disposed in each cavity. The switch assembly has an open position and a closed position, with the closed position permitting electrical communication between the electrical contacts disposed in the cavities. The open position, however, substantially does not permitting electrical communication between the electrical contacts. When the electrical bridging clip is installed in the terminal block, a conductive terminal in the terminal block inserts into each cavity and electrically communicates with the electrical contact disposed in each cavity. The switch assembly permits electrical communication between two conductive terminals in the terminal block via the electrical contacts.

This invention also encompasses an electrical bridging clip strip. This electrical bridging clip strip is used with a terminal block. The electrical bridging clip strip retrofits into existing terminal block installations. The electrical bridging clip strip comprises one or more electrical bridging clips affixed to an elongate bracket. The elongate bracket has a plurality of spaced apertures, with the apertures vertically arranged along a longitudinal axis of the bracket. The electrical bridging clip is at least partially exposed through an aperture in the bracket. The electrical bridging clip has a first and a second electrical contact in electrical communication with a switch assembly. The first electrical contact is for electrically communicating with a first conductive terminal of the terminal block. The second electrical contact is for electrically communicating with a second conductive terminal of the terminal block. The switch assembly has a movable member that is accessible via the aperture. The movable member selects between an open position and a closed position. The closed position permits electrical communication between the first and the second electrical contact, and the open position substantially does not permit electrical communication between the first and the second electrical contact. When the electrical bridging clip strip is installed in the terminal block, the first electrical contact electrically communicates with the first conductive terminal, and the second electrical contact electrically communicates with the second conductive terminal. The switch assembly permits electrical communication between the first and second conductive terminals via the first and second electrical contacts.

BRIEF DESCRIPTION OF THE SEVERAL VIEWS OF THE DRAWINGS

These and other features, aspects, and advantages of this invention are better understood when the following Detailed Description of the Invention is read with reference to the accompanying drawings, wherein.

DETAILED DESCRIPTION OF THE INVENTION

Figure 1:
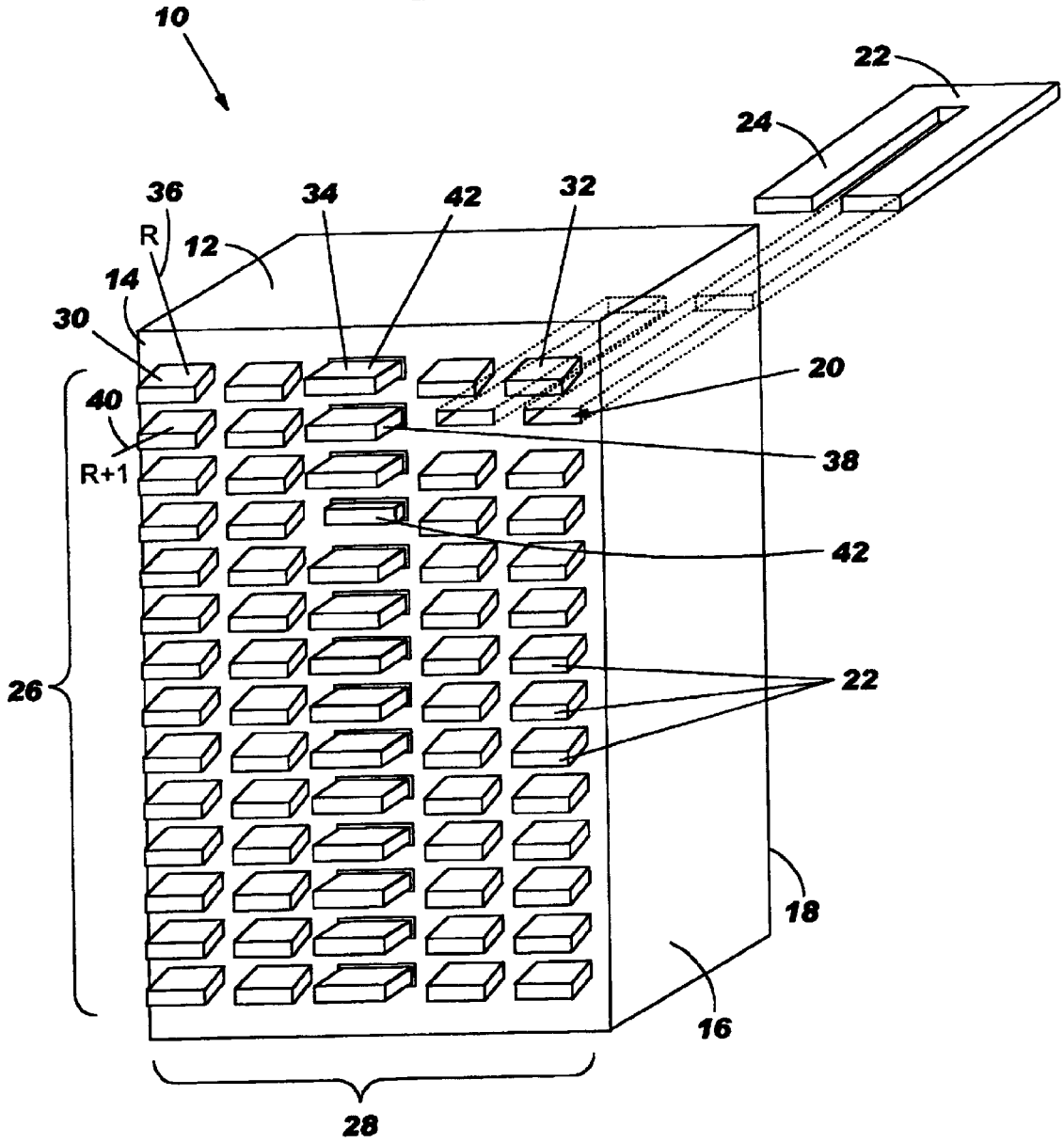
FIG. 1 is an isometric drawing of a terminal block according to this invention.

FIG. 1 is an isometric drawing of a terminal block 10 according to this invention. The terminal block 10 has a block body 12. The block body 12 has a front surface 14, one or more side surfaces 16, and a back surface 18. The back surface 18, although not shown, may be recessed within the block body 12. The block body 12 also has at least one slotted passage 20 extending from the front surface 14 to the back surface 18. A conductive, "U"-shaped terminal 22 is then disposed in adjoining slotted passages 20. The conductive terminal 22 is typically inserted into the slotted passages 20 from the back surface 18. The conductive terminal 22 extends into and through the block body 12, and finger portions 24 of the conductive terminal 22 outwardly extend from the front surface 14. The terminal block 10 commonly has a plurality of conductive terminals 22 outwardly extending from the front surface 14, and the plurality of conductive terminals 22 are arranged in an array of rows 26 and columns 28. Each row 26 has a left conductive terminal 30 and a right conductive terminal 32.

The terminal block 10 of this invention also includes at least one switch assembly 34. Each switch assembly 34 has an open position and a closed position. The closed position permits electrical communication between adjacent conductive terminals 22 in a single row of the array. The open position, conversely, substantially does not permit electrical communication between adjacent conductive terminals in the same row. FIG. 1, for example, shows the left conductive terminal 30 corresponding to a row "R" (shown as reference numeral 36). The right conductive terminal 32 also corresponds to the same row "R." When electrical communication is desired between the left conductive terminal 30 and the right conductive terminal 32, the switch assembly 34 is set to the closed position. Any voltage applied to the left conductive terminal 30 is then also present at the right conductive terminal 32. Any current would flow from the left conductive terminal 30, through the switch assembly 34, and on to the right conductive terminal 32. When electrical communication is not desired, the switch assembly 34 is set to the open position. The term "electrical communication" means current and voltage is transmitted between the switch assembly and the conductive terminals by contact or by electromagnetic induction.

FIG. 1 shows a switch assembly corresponding to each row in the array 24. The switch assembly 34, for example, establishes electrical communication between the left conductive terminal 30 and the right conductive terminal 32 of row "R" (shown as reference numeral 36). Another switch assembly 38, for example, establishes electrical communication between a left conductive terminal 36 and a right conductive terminal 38 of row "R+1" (shown as reference numeral 40). The terminal block 10 preferably has a separate switch assembly for each row in the array of conductive terminals. A separate switch assembly for each row allows electrical communication to be established, or severed, for any row. Although FIG. 1 shows the switch assembly 34 arranged between the left conductive terminal 30 and the right conductive terminal 32, any other arrangement is suitable.

The switch assembly 34 may be any switch design. FIG. 1, for example, shows the switch assembly 34 as a push-button switch. Pushing a button 42 inward, for example, closes the switch assembly 34 and establishes electrical communication between the adjacent left conductive terminal 30 and the right conductive terminal 32. Another push of the button 42 opens the switch assembly 34 and severs electrical communication. The switch assembly 34, however, could be any switch design having at least an open position and a closed position. Rotary switches, rocker switches, toggle switches, and slide switches are but a small listing of the various switch designs that are applicable to this invention. The switch assembly 34 could also include a light to indicate whether the switch assembly is in the "closed" position or the "open" position.

FIG. 1 shows the conductive terminal 22 having a "U"-shape. This "U"-shaped conductive terminal 22, having the finger portions 24, is frequently used in RJ21 terminal blocks for telecommunications networks. Those of ordinary skill in the art, however, will now recognize that this invention is independent of the shape of the conductive terminals 22. As long as the switch assembly 34 is in electrical communication with conductive terminals, the shape of the post-type conductive terminals is not important.

Figure 2:
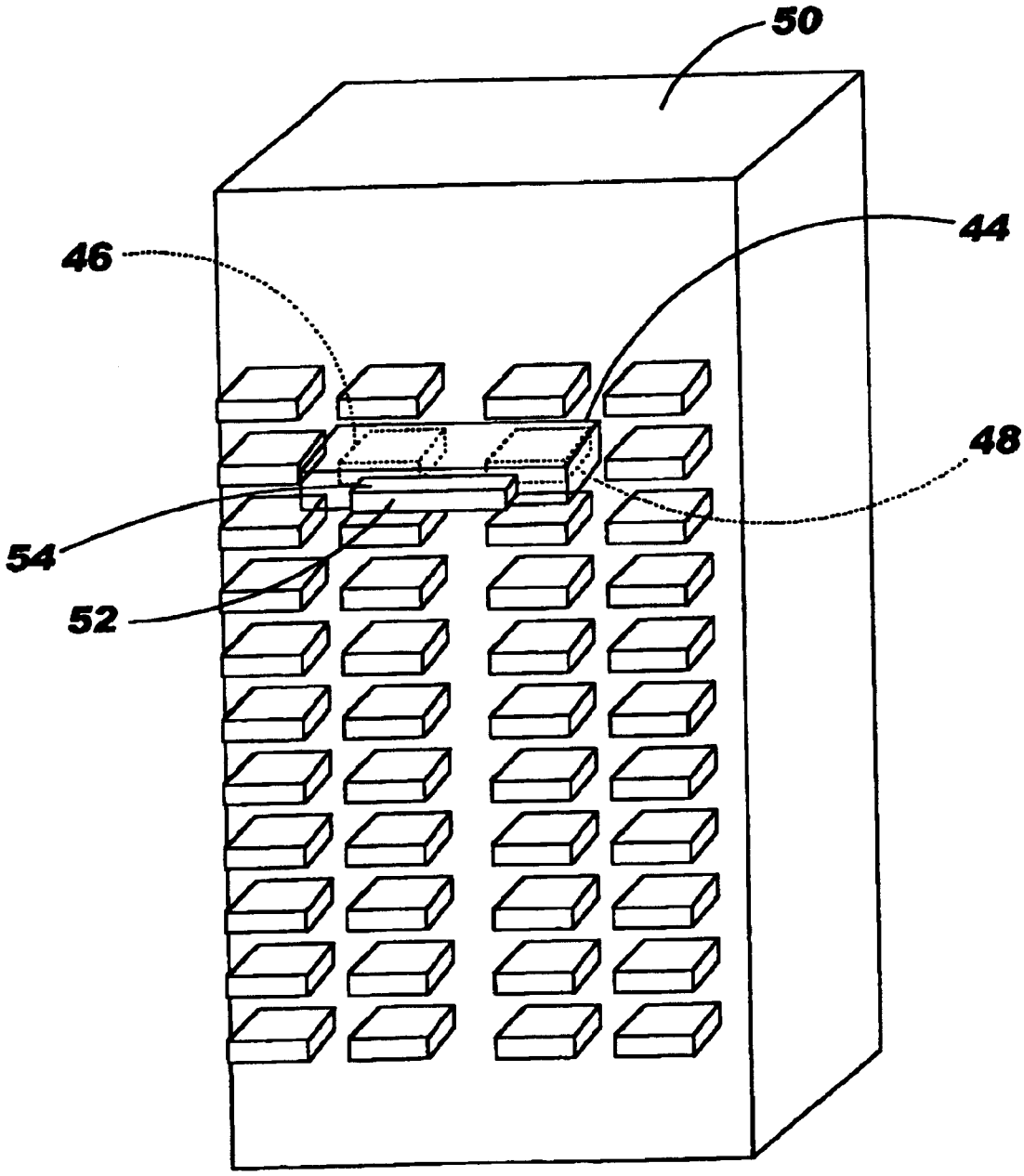
FIGS. 2–6 are drawings showing another embodiment of this invention.

FIG. 2 is an isometric drawing showing another embodiment of this invention. Here an electrical bridging clip 44 is used to establish electrical communication between adjacent post-type conductive terminals 46 and 48 in a terminal block 50. The electrical bridging clip 44 is inserted onto the adjacent conductive terminals 46 and 48, and a switch assembly 52 permits electrical communication between the adjacent conductive terminals 46 and 48. The switch assembly 52 has an open position and a closed position. The closed position permits electrical communication between the adjacent conductive terminals 46 and 48. The open position, conversely, substantially does not permit electrical communication between the adjacent conductive terminals 46 and 48. FIG. 2 shows the switch assembly 52 as a push-button switch. Pushing a button 54 inward, for example, closes the switch assembly 52 and establishes electrical communication. Another push of the button 54 opens the switch assembly 52 and severs electrical communication. The switch assembly 52, however, could be any switch design having at least an open position and a closed position. The switch assembly 52 could also include a light to indicate whether the switch assembly is in the "closed" position or the "open" position.

Figure 3:
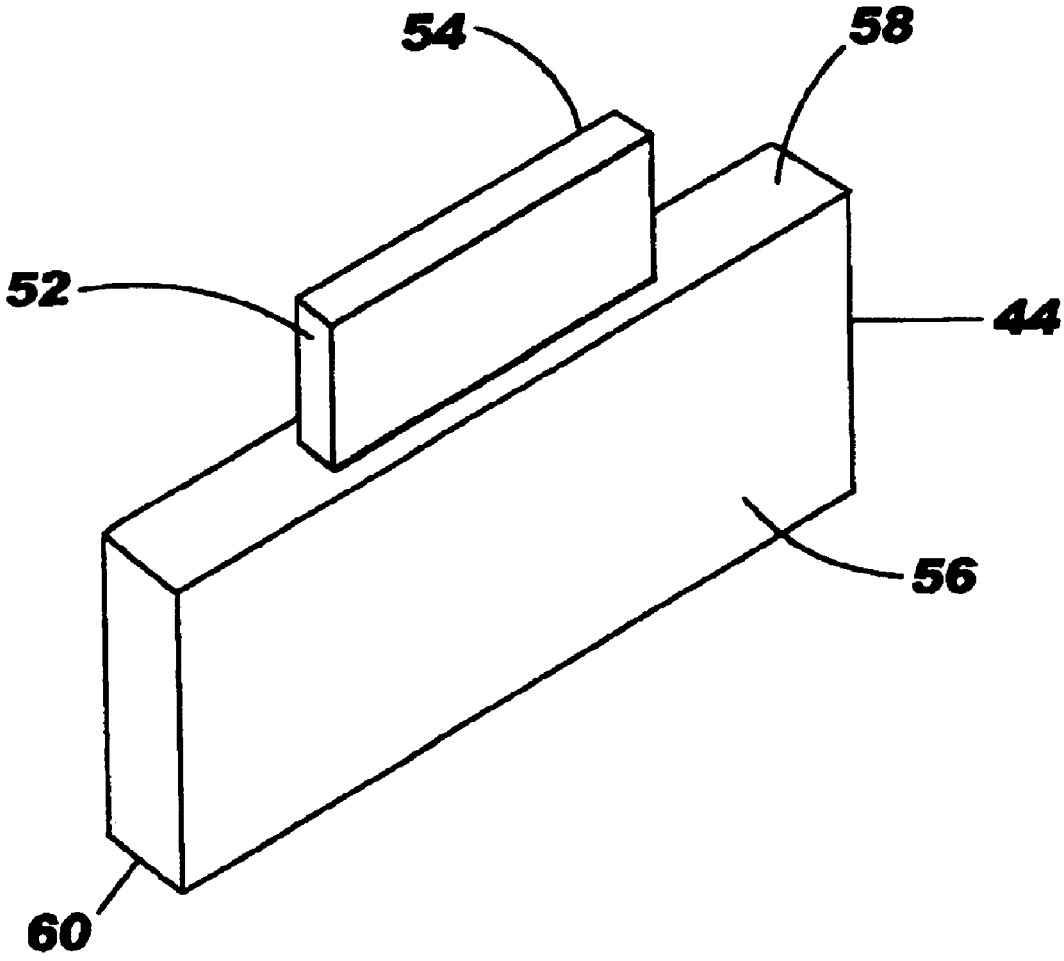
Figure 4:
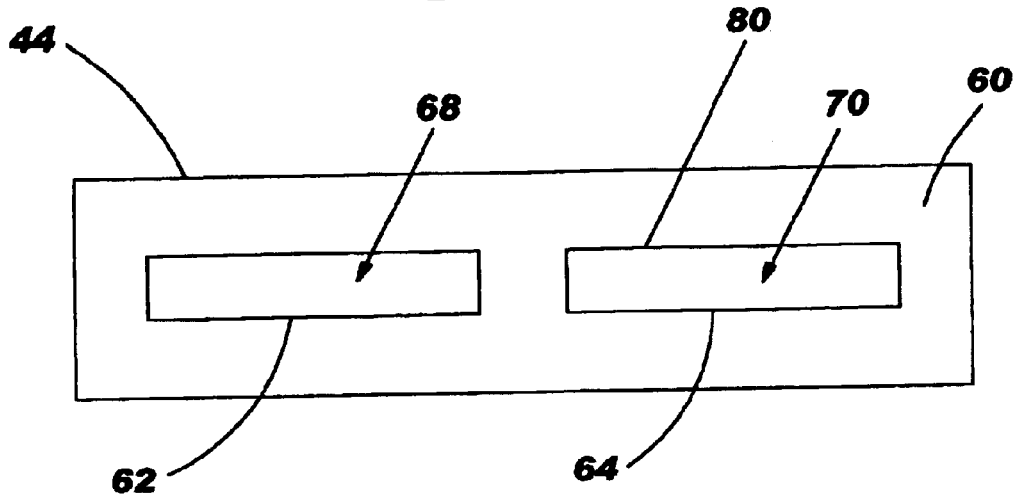
Figure 5:
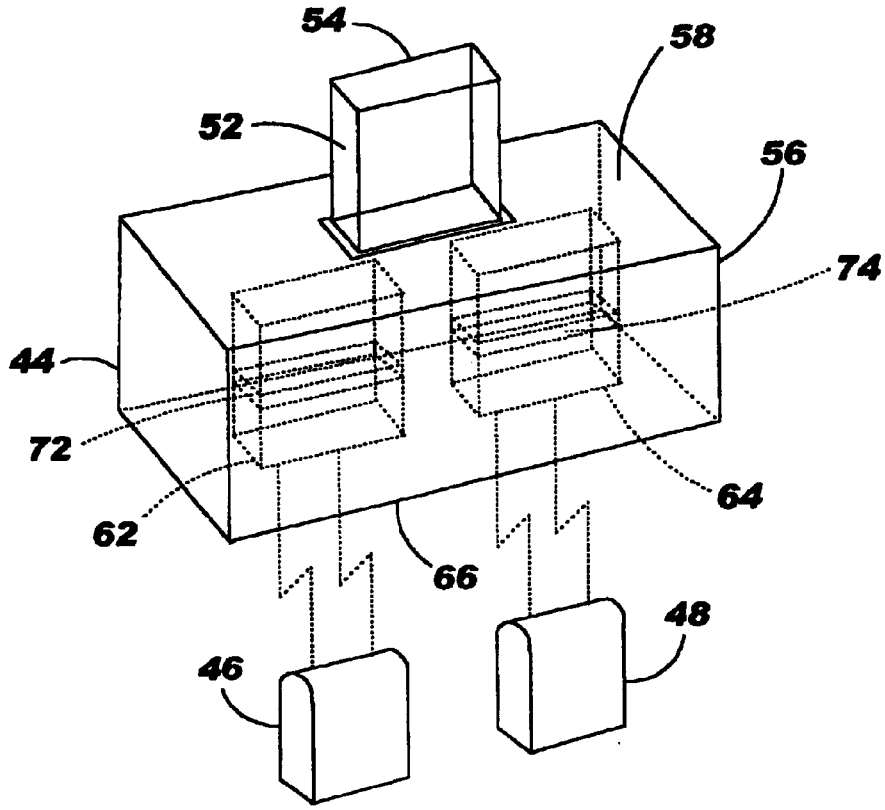
Figure 6:
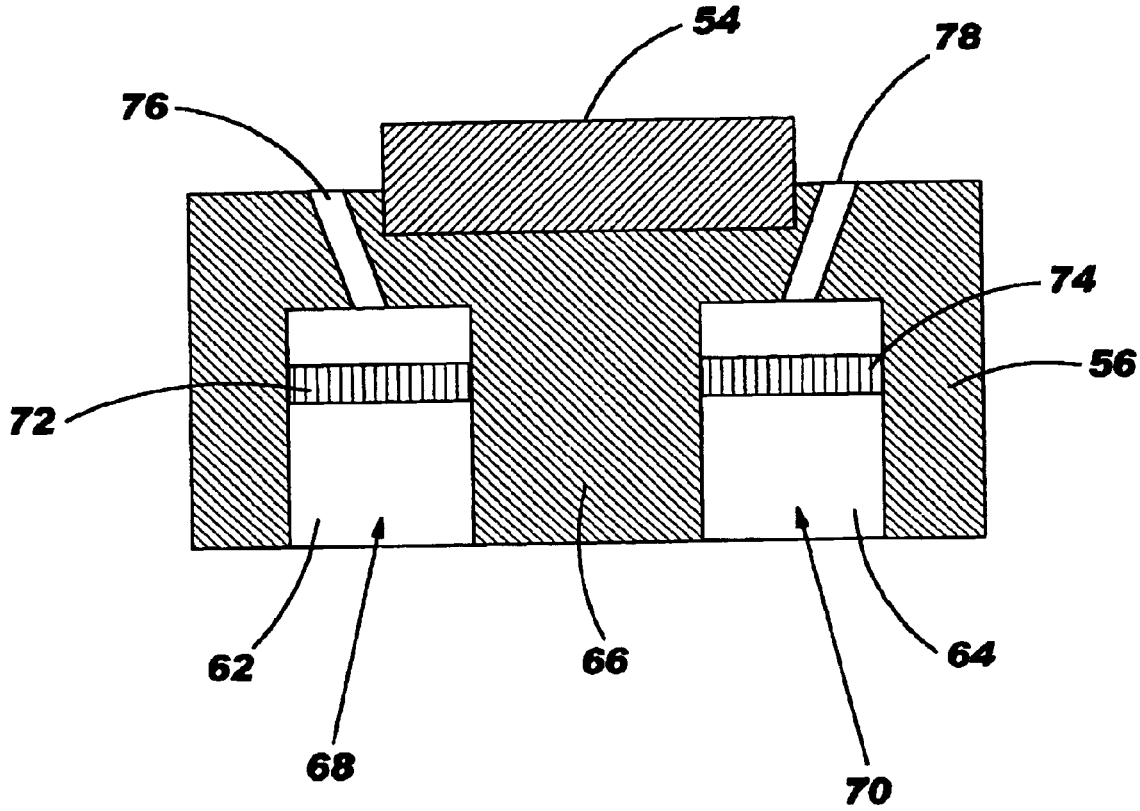

FIGS. 3–6 are views of the electrical bridging clip 44 shown in FIG. 2. FIG. 3 is an isometric view of the electrical bridging clip 44, while FIG. 4 is an orthographic bottom view. FIGS. 5 and 6 are enlarged sectional views showing some interior details. The electrical bridging clip 44 has a generally rectangularly-shaped housing 56 constructed of a substantially non-conductive material. The housing 56 has a top face 58, a bottom face 60, and at least one pair of spaced cavities 62 and 64. Each cavity 62, 64 upwardly extends from the bottom face 60 and into an interior region 66 of the housing 56. Each cavity 62, 64 terminates at an opening 68, 70 on the bottom face 60. Each opening 68 and 70, and each cavity 62 and 64, is preferably sized to accept the post-type conductive terminals 46, 48 from an RJ21 terminal block (shown as reference numeral 50 in FIG. 2). When the electrical bridging clip 44 is inserted onto the adjacent post-type conductive terminals, an electrical contact 72, 74 disposed in each cavity 62, 64 electrically communicates with the respective conductive terminals 46, 48.

The electrical bridging clip 44 also comprises the switch assembly 52. The closed position of the switch assembly 52 permits electrical communication between the electrical contacts 72 and 74. The open position of the switch assembly 52 substantially does not permit electrical communication between the electrical contacts 72 and 74. When the electrical bridging clip 44 is installed in the terminal block, the conductive terminals 46 and 48 insert into the respective cavities 62 and 64. The conductive terminals 46, 48 electrically communicate with the electrical contacts 72, 74 disposed in each cavity 62, 64. The switch assembly 52 permits electrical communication between the contacts 72 and 74 and, thus, the conductive terminals 46 and 48. Although FIGS. 3–6 show the switch assembly 52 as a push-button switch, the switch assembly 52, however, could be any switch design having at least an open position and a closed position. The switch assembly 52 could also include a light to indicate whether the switch assembly is in the "closed" position or the "open" position.

FIG. 6 additionally shows apertures 76 and 78. These apertures 76 and 78 extend from the top face 58 of the housing 56 into each respective cavity 62, 64. The apertures 76, 78 allow a test probe to access the electrical contact 72, 74 and the conductive terminal 46, 48.

FIGS. 3–6 show the spaced cavities 62 and 64 having a rectangular cross section. Because most RJ21 terminal blocks have bladed, post-type conductive terminals, the openings 66 and 68 preferably have a slotted cross-sectional shape 80. The spaced cavities 62 and 64 are also shown with a parallel arrangement, again conforming to the terminal arrangement of the RJ21 terminal block. The cavities 62 and 64, however, may have any cross-sectional shape and arrangement. Those of ordinary skill in the art will now recognize that this invention is independent of the shape and of the arrangement of the conductive terminals. This invention, likewise, is independent of the shape and of the arrangement of the electrical contacts 72 and 74. As long as the electrical contacts 72 and 74 electrically communicate with the switch assembly 52 and with the post-type conductive terminals 46 and 48, the electrical contacts 72 and 74 may have any shape, arrangement, or configuration.

Figure 7:
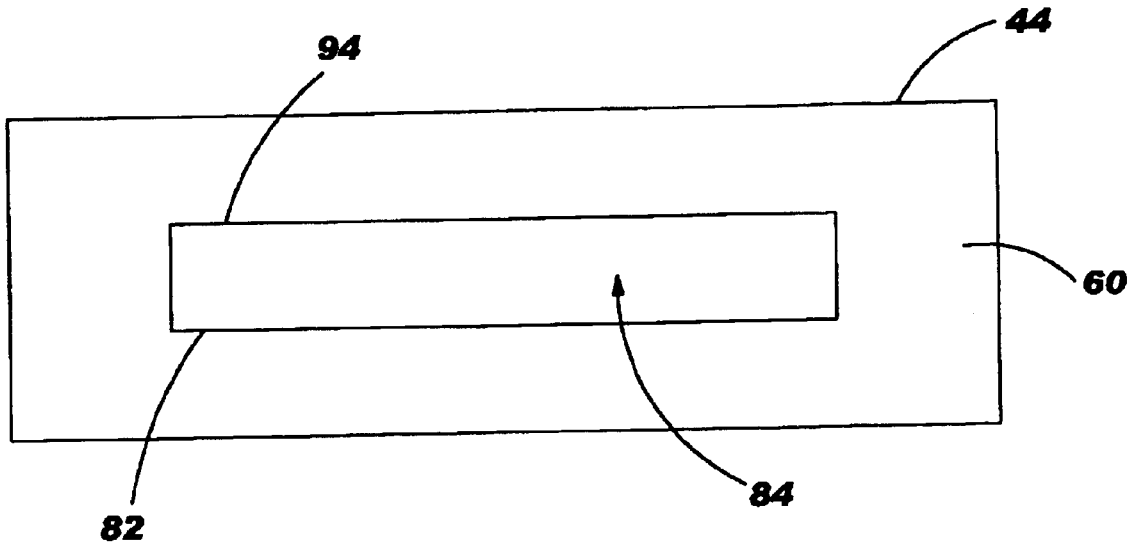
FIGS. 7–9 are drawings showing yet another embodiment of this invention.
Figure 8:
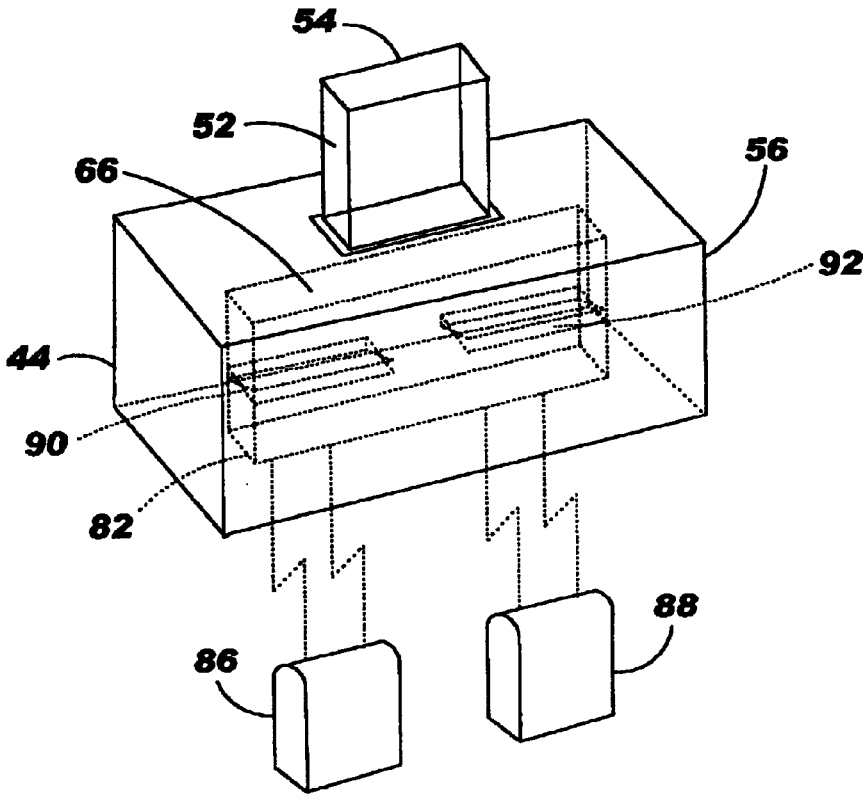
Figure 9:
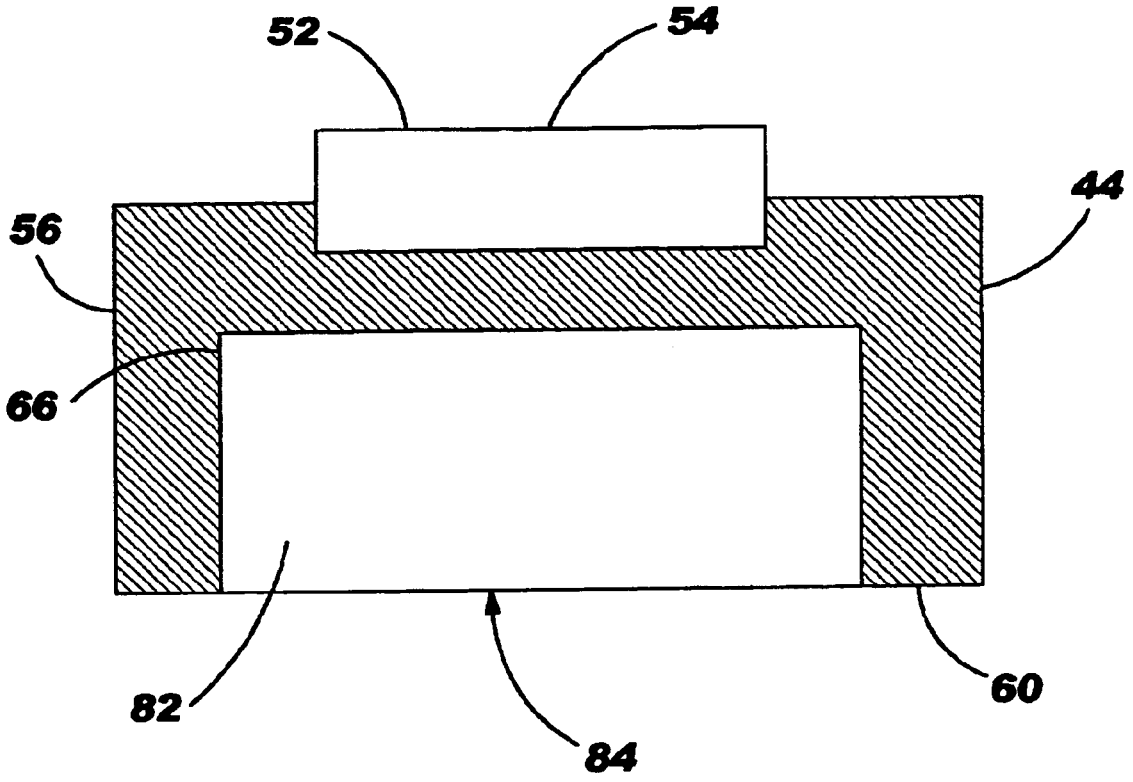

FIGS. 7–9 show another embodiment of the electrical bridging clip 44 according to this invention. FIGS. 7–9 are very similar to FIGS. 4-6, yet this embodiment only has a single cavity 82. The cavity 82 upwardly extends from the bottom face 60 and into the interior region 66 of the housing 56. The cavity 82 terminates at an opening 84 on the bottom face 60. The opening 84 and the cavity 82 are preferably sized to accept at least two post-type conductive terminals 86 and 88 from the RJ21 terminal block (shown as reference numeral 50 in FIG. 2). At least two electrical contacts 90 and 92 are disposed in the cavity 82. The first electrical contact 90 electrically communicates with the first conductive terminal 86 of the terminal block, and a second electrical contact 92 electrically communicates with a second conductive terminal 88 of the terminal block.

The electrical bridging clip 44 shown in FIGS. 7–9 also includes the switch assembly 52. The switch assembly 52 is in electrical communication with the at least two electrical contacts 90 and 92. The switch assembly 52 has an open position and a closed position. The closed position permits electrical communication between the at least two electrical contacts 90 and 92. The open position substantially does not permit electrical communication between the at least two electrical contacts 90 and 92. When the electrical bridging clip 44 is installed in the terminal block, the at least two conductive terminals 86 and 88 in the terminal block insert into the cavity 82. The at least two electrical contacts 90 and 92 electrically communicate with the respective conductive terminals 86 and 88. The switch assembly 52 permits an electrical connection between the at least two conductive terminals 86 and 88 via the electrical contacts 90 and 92.

FIGS. 7–9 show the cavity 82 having a slotted, rectangular cross-section 94. This slotted, rectangular cross-section 94, as before, conforms to the bladed conductive terminals of RJ21 terminal blocks. The cavity 82, however, may have any cross-sectional shape, and this invention is independent of the shape and of the arrangement of the post-type conductive terminals. For example, although only the two conductive terminals 86 and 88 are shown in FIG.

8, the cavity 82 could be sized to accept more than two conductive terminals from the terminal block. The switch assembly 52, then, could permit electrical communication between any selected pair of conductive terminals. This invention, likewise, is independent of the shape and of the arrangement of the electrical contacts 90 and 92. As long as the electrical contacts 90 and 92 electrically communicate with the switch assembly 52 and with the conductive terminal 86 and 88, the electrical contacts 90 and 92 may have any shape, arrangement, or configuration.

Figure 10:
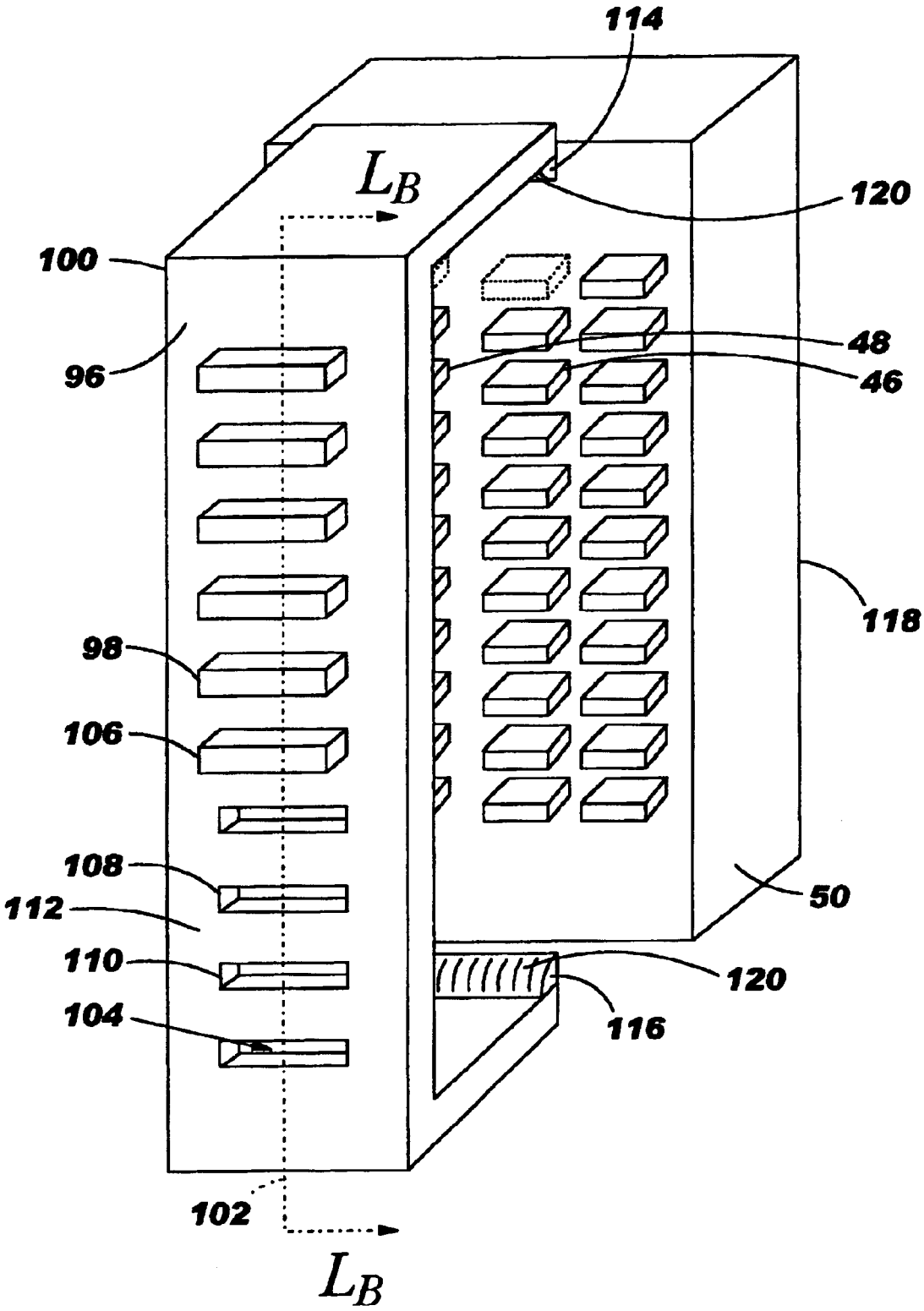
FIG. 10 illustrates still another embodiment of this invention.

FIG. 10 is an isometric view of an electrical bridging clip strip 96 according to another embodiment of this invention. This electrical bridging clip strip 96 allows a technician to eliminate the small and cumbersome prior art bridge clips from existing terminal block installations. This electrical bridging clip strip 96 also provides a quick and easy retrofit for terminal blocks already installed and wired in the field. The electrical bridging clip strip 96 comprises one or more electrical bridging clips 98 affixed to an elongate bracket 100. The elongate bracket 100 defines a longitudinal axis $L_B$-$L_B$ (shown as reference numeral 102). The bracket 100 has a plurality of spaced apertures 104 vertically arranged along the longitudinal axis 102. Each electrical bridging clip 98 is at least partially exposed through an aperture 102 in the bracket 100. Each electrical bridging clip 98 comprises electrical contacts (not shown) in electrical communication with a switch assembly 106. The electrical contacts electrically communicate with the conductive terminals 46, 48 of the terminal block 50. The switch assembly 106 has an open position and a closed position, with the closed position permitting electrical communication between the post-type conductive terminals 46 and 48 via the electrical contacts. Although the switch assembly 106 is shown as a push-button switch, the switch assembly 106 could be any switch design having an open position and a closed position. The switch assembly 106 could also include a light to indicate whether the switch assembly is in the "closed" position or the "open" position.

The electrical bridging clip 98 could also include a single cavity (such as the cavity 82 shown and discussed with reference to FIGS. 7–9). This single cavity is preferably sized to accept insertion of at least the two conductive terminals 46 and 48 from the RJ21 terminal block 50. The electrical bridging clip 98 could alternatively also include a cavity corresponding to each conductive terminal (such as the cavities 62 and 64 shown and discussed with reference to FIGS. 3–6).

The bracket 100 resembles a ladder. Elongate side rails 108 and 110 are separated by multiple transverse members 112. The transverse members 112 are vertically spaced along the longitudinal axis $L_B$-$L_B$ (shown as reference numeral 102) to form the spaced apertures 104. The preferred embodiment would have an aperture 104 corresponding to each row of conductive terminals in the terminal block 50. Because an aperture 104 corresponds to each row of conductive terminals, each row could also have a corresponding electrical bridging clip 98. The bracket 100 may also include means for securing the bracket 100 to the terminal block 50. FIG. 10, for example, shows a pair of hooked tabs 114, 116. The hooked tabs 114, 116 extend from the bracket 100 to a backside 118 of the terminal block 50. The hooked tabs 114, 116 are prefereably constructed of a pliable material, such as plastic. A claw 120 on each hooked tab 114, 116 engages the terminal block 50 at the backside 118. The means for securing the bracket 100 to the terminal block 50 could alternatively, or additionally, comprise threaded screws or bolts to secure the bracket 100.

While the present invention has been described with respect to various features, aspects, and embodiments, those skilled and unskilled and unskilled in the art will recognize the invention is not so limited. Other variations, modifications, and alternative embodiments may be made without departing from the spirit and scope of the present invention.

What is claimed is:

1. An electrical bridging clip, comprising:

a first and a second electrical contact in electrical communication with a switch assembly, the first electrical contact for electrically communicating with a first conductive terminal of a terminal block, the second electrical contact for electrically communicating with a second conductive terminal of the terminal block, the terminal block having a plurality of conductive terminals arranged in an array of rows and columns, the switch assembly having an open position and a closed position, the closed position permitting electrical communication between the first and the second electrical contact, and the open position substantially not permitting electrical communication between the first and the second electrical contact, wherein when the electrical bridging clip is installed in the terminal block, the switch assembly permits electrical communication between the first and second conductive terminals via the first and second electrical contacts.

2. An electrical bridging clip, comprising:

a housing comprising a top face, a bottom face, and a cavity, the cavity upwardly extending from the bottom face into an interior region of the housing, the cavity terminating at an opening on the bottom face, the opening and the cavity sized to accept at least two conductive terminals from a terminal block, the terminal block having a plurality of conductive terminals arranged in an array of rows and columns;

at least two electrical contacts disposed in the cavity, a first electrical contact for electrically communicating with a first conductive terminal of the terminal block, and a second electrical contact for electrically communicating with a second conductive terminal of the terminal block; and a switch assembly in electrical communication with the at least two electrical contacts, the switch assembly having an open position and a closed position, the closed position permitting electrical communication between the at least two electrical contacts, and the open position substantially not permitting electrical communication between the at least two electrical contacts, wherein when the electrical bridging clip is installed in the terminal block, the at least two conductive terminals in the terminal block insert into the cavity, and the switch assembly permits an electrical connection between the at least two conductive terminals via the electrical contacts.

3. An electrical bridging clip, comprising:

a housing comprising a top face, a bottom face, and at least one pair of spaced cavities, each cavity upwardly extending from the bottom face and into an interior region of the housing, each cavity terminating at an opening on the bottom face, each opening and each cavity sized to accept an electrical terminal from a terminal block, the terminal block having a plurality of conductive terminals arranged in an array of rows and columns;

an electrical contact disposed in each cavity; and a switch assembly in electrical communication with the electrical contact disposed in each cavity, the switch assembly having an open position and a closed position, the closed position permitting electrical communication between the electrical contacts disposed in the cavities, and the open position substantially not permitting electrical communication between the electrical contacts disposed in the cavities, wherein when the electrical bridging clip is installed in the terminal block, a conductive terminal in the terminal block inserts into each cavity and electrically communicates with the electrical contact disposed in each cavity, and the switch assembly permits electrical communication between two conductive terminals in the terminal block via the electrical contacts.

4. A electrical bridging clip according to claim 3, wherein the at least one pair of spaced cavities have a parallel arrangement.

5. A electrical bridging clip according to claim 3, wherein a cavity terminates at a slotted opening on the bottom face.

6. An electrical bridging clip according to claim 3, wherein a cavity has a rectangular cross-section.

7. An electrical bridging clip according to claim 3, wherein the housing is constructed of a substantially non-conductive material.

8. An electrical bridging clip according to claim 3, further comprising an aperture extending from the top face of the housing into a cavity, the aperture allowing access of a test probe.

* * * * *